US008317062B2

(12) United States Patent
Bodet et al.

(10) Patent No.: US 8,317,062 B2
(45) Date of Patent: Nov. 27, 2012

(54) TWO-WAY VALVE

(75) Inventors: Herve Bodet, Verdun (FR); Hans-Peter Lilienthal, Hamburg (DE)

(73) Assignee: Lindal France SAS, Briey (FR)

( * ) Notice: Subject to any disclaimer, the term of this patent is extended or adjusted under 35 U.S.C. 154(b) by 964 days.

(21) Appl. No.: 12/300,498

(22) PCT Filed: May 16, 2007

(86) PCT No.: PCT/EP2007/054780

§ 371 (c)(1),
(2), (4) Date: Nov. 12, 2008

(87) PCT Pub. No.: WO2007/132017

PCT Pub. Date: Nov. 22, 2007

(65) Prior Publication Data

US 2009/0230344 A1 Sep. 17, 2009

(30) Foreign Application Priority Data

May 16, 2006 (FR) ..... 06 51759

(51) Int. Cl.
*B65D 35/28* (2006.01)

(52) U.S. Cl. ..... 222/95; 222/94; 222/105; 222/136; 222/394; 222/402.1; 222/402.25

(58) Field of Classification Search ..... 222/94–95, 222/105, 102, 402.1, 386.5, 394, 402.22, 222/402.25, 129, 131, 135–136, 402.24, 222/402.23

See application file for complete search history.

(56) References Cited

U.S. PATENT DOCUMENTS 3,474,934 A * 10/1969 Forim ..... 222/136
3,625,400 A 12/1971 Friedrich
3,674,180 A 7/1972 Morane
3,682,355 A 8/1972 Lo (Continued)

FOREIGN PATENT DOCUMENTS

DE 17 86 036 A1 7/1971

(Continued)

OTHER PUBLICATIONS

International Preliminary Report on Patentability of International Application No. PCT/EP2007/054780 dated Dec. 10, 2008 with Forms PCT/IB/373 and PCT/ISA/237.

(Continued)

*Primary Examiner* — Frederick C. Nicolas
(74) *Attorney, Agent, or Firm* — Westerman, Hattori, Daniels & Adrian, LLP

(57) ABSTRACT

A valve for distributing two fluids contained in a rigid flask by propulsion, the first fluid contained in a first flexible pouch, and the second fluid in the flask so as to be isolated from the first fluid before the fluid leaves through the valve. When the valve is placed on the flask, an internal part of the valve is inside the flask, an external part of the valve is outside the flask. A first passage which can be closed connects the inside of the first pouch and the space surrounding the external part of the valve, and a second passage which can also be closed connects the space intended to receive the second fluid and the space surrounding the external part of the valve. The valve has a second flexible pouch for receiving the second fluid, which is fixed to the valve and placed around the first pouch.

16 Claims, 5 Drawing Sheets

U.S. PATENT DOCUMENTS

| | | | | |
|---|---|---|---|---|
| 6,789,702 | B2 * | 9/2004 | O'Connor et al. | 222/96 |
| 7,267,248 | B2 * | 9/2007 | Yerby et al. | 222/94 |
| 2002/0033394 | A1 * | 3/2002 | Towfighi | 220/89.2 |
| 2003/0024953 | A1 | 2/2003 | Lilienthal | |
| 2003/0089739 | A1 * | 5/2003 | O'Connor et al. | 222/145.5 |
| 2004/0004088 | A1 * | 1/2004 | Yerby et al. | 222/145.5 |
| 2004/0084477 | A1 * | 5/2004 | Albaum | 222/95 |

FOREIGN PATENT DOCUMENTS

| | | | |
|---|---|---|---|
| DE | 21 60 268 | A1 | 6/1973 |
| EP | 0 098 476 | A2 | 1/1984 |
| EP | 1 281 635 | A1 | 2/2003 |
| JP | 64-39288 | U | 3/1989 |
| JP | 2004-244109 | A | 9/2004 |

OTHER PUBLICATIONS

International Search Report of PCT/EP2007/054780, date of mailing Aug. 30, 2007.

Japanese Office Action dated Jun. 5, 2012 issued in counterpart Japanese Patent Application No. 2009-510458, w/English translation.

* cited by examiner

Fig. 3a
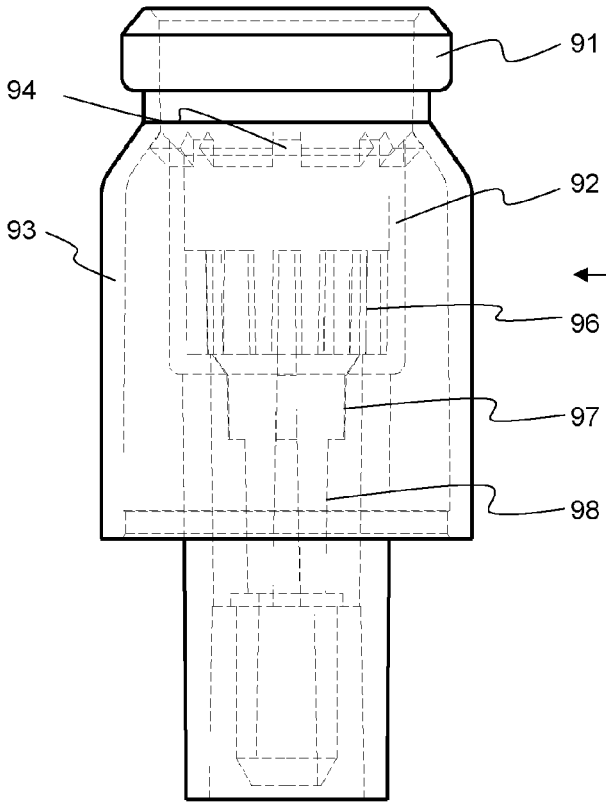
Fig. 3b
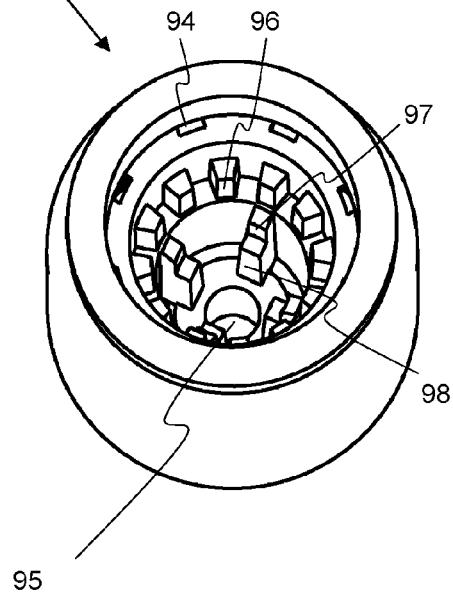
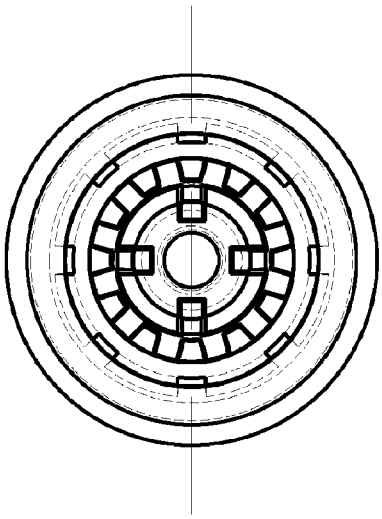
Fig. 3c

TWO-WAY VALVE

BACKGROUND ART

The invention concerns a valve for the distribution of two fluids and intended to be fixed on a rigid receptacle, wherein the valve is configured with an outside and an inside, wherein the outside is intended to be located out of a receptacle when the valve is fixed on the receptacle and the inside is intended to be located within the receptacle when the valve is fixed on the receptacle, wherein the valve comprises

- a first flexible pouch intended to receive a first fluid;
- a second flexible pouch intended to receive a second fluid;
- a first passage connecting an inside of the first pouch with an outside of the valve;
- a second passage connecting an inside of the second pouch with an outside of the valve, first closure means for closing the first passage and second closure means for closing the second passage.

Such valves make it possible to take off from pressurised bottles two fluids that must be separated before use so that they do not react together before use. This is the case for example with hair dyes.

Valves are known for example from the document EP 1 281 635 A1. A first liquid is contained in a flexible pouch that is itself situated in a rigid flask containing firstly the propellant gas and secondly the second component of the product, for example a gel. The valve consists of two channels, one of which can be put in contact with the flexible pouch and the other with the inside of the receptacle when the valve is actuated. The fluid in the pouch is not in contact with the fluid contained in the flask with the gas. When the valve is actuated, the propellant gas propels the second fluid through the second passage. In addition, because of the pressure prevailing in the flask, the gas bears on the walls of the pouch, thus forcing its content to emerge through the first passage. The two components meet only on leaving the valve, for example in a diffuser. This solution has the major drawback that the second component is mixed with the propellant gas. In addition, the gas is necessarily expelled with this second component.

Other solutions provide a second flexible pouch containing the second fluid, the propellant gas than being situated outside the second flexible pouch.

In a first variant, the two pouches are placed side by side. A system of parallel double pouches each provided with a valve is known from the document WO 2005/087616 A1. The two pouches are contained in a rigid receptacle under pressure. The two components are both isolated from the gas and each emerge through a valve. The propellant gas cannot escape from the receptacle. This solution has the drawback of requiring two valves. The document U.S. Pat. No. 3,674,180 A has a valve with two parallel inlets, on each of which a flexible pouch is fixed. The two pouches are therefore parallel. The drawback of parallel pouches lies in the fact that the occupation of the internal space of the flask is not optimum. In addition, the pouches not being disposed in the axis of the valve, it is difficult to coil them to enable them to be introduced into the receptacle before filling. In addition, the volume of the two pouches is necessarily similar, it is not possible, unless the dead volume in the receptacle is increased further, to have one pouch appreciably larger than the other. Finally, it is not possible to fill the pouches from the valve, since the two parallel inlets end up in a common channel. It is therefore necessary to fill each pouch from the bottom before sealing it and closing the receptacle under pressure.

In a second variant, the two pouches are concentric. In the document EP 0 098 476 A2, the internal pouch is fixed to the valve and the external pouch is fixed to the flask itself. In the document DE 1 786 036 A1, the external pouch is first of all fixed to the flask and then the internal pouch is introduced into the flask while being held in the high position by hooks that bear on the neck of the flask before the pouches are filled. After filling, the valve is snapped onto the neck of the internal pouch, still held in the high position by the hooks. Finally, the valve is pressed into the flask, drawing with it the hooks inside the flask. In both cases, it is not possible in a first step to manufacture the valve, with the two pouches, that can then be introduced by the cosmetic manufacturer into the flask before it is filled.

The document DE 2 160 268 A1 present a hermetically sealed flask containing two concentric pouches. During use, this flask is introduced into a bottle equipped with an atomiser. The base of the atomiser is provided with two parallel spikes that perforate the flask at two distinct points so that the first spike enters the internal pouch and the second the external pouch. Here also, it is not possible to manufacture in a first step a valve provided with its two pouches.

SUMMARY OF THE INVENTION

The objective of the invention is therefore to develop the valve according to the pre-characterising clause that makes it possible to separate the two fluids and the gas while having only a single valve. The valve must be able to be manufactured in a first step with its two pouches in order to be able to be introduced later into a rigid receptacle before it is filled, preferably by the part of the valve projecting out of the receptacle. Another objective is to where applicable make it possible to allow the gas to escape from the receptacle. Another objective is to allow the addition of a third component in the propellant gas.

This objective is achieved according to the invention because the first pouch is placed inside the second pouch. In this way, the dead space in the flask is reduced and the filling ratio is thus increased. In addition, the two pouches being in the coiling axis, coiling is facilitated and there is no risk of the pouches tearing. Moreover, the volume of each pouch can be chosen freely and it is thus possible to vary as required the ratio between the two volumes. Finally, it is possible to fill the two pouches from the valve by virtue of the two passages, which preferably do not have a portion in common.

It is preferable to provide the first passage with first closure means, which, depending on whether they are open or closed, put in contact or isolate the inside of the first pouch with the outside of the valve, and to provide the second passage with second closure means which, depending on whether they are open or closed, put in contact or isolate the inside of the second pouch with the outside of the valve.

In one embodiment of the invention, the first passage and the second passage consist of two concentric channels, one of which can be put into contact with the first flexible pouch and the other with the second flexible pouch when the closure means are open. This is a simple means of accessing the content of the two pouches, one of which is placed inside the other.

The propulsion means are formed by means for exerting a pressure on the second flexible pouch. In a known fashion, these means for exerting a pressure on the second flexible pouch are formed by a pressurised gas contained in a rigid receptacle in which the two pouches are placed.

In order if necessary to enable the propellant gas to emerge from the receptacle in order to participate in the formation of a spray, it is possible to provide a third passage provided with third closure means which, depending on whether they are open or closed, put in contact or isolate the space situated outside the second pouch, but inside the rigid receptacle when the valve is mounted on such a receptacle, with the outside of the valve, the third passage being able to emerge in the first or second passage downstream, with respect to the direction of travel of the fluids when taking off, of the closure means of the said first or second passage. It is also possible to add to the propellant gas a third fluid, which, while being separated from the other two fluids, can form part of the composition of the final product emerging from the valve.

In a favoured embodiment of the invention, the closure means each consist of a hole produced in a wall able to move between a position in which they emerge on one side at least on a second wall so that they form blind holes and a position in which they emerge on one side on spaces in contact with the inside of the pouches and on the other on spaces in contact with the outside of the valve.

It is preferable for the valve to comprise a valve body that can be secured to a cup to be fixed to a rigid receptacle, and a stem placed in the valve body and provided with means for moving it between a first position in which the closure means are closed and a second position in which the closure means are open. The means for moving the stem between the two positions preferably consist firstly of a spring and secondly of means on which a force counter to the action of the spring can be exerted. The latter means will for example consist of a diffuser placed on the valve.

In more detail, a valve according to the invention consists essentially of a stem, a valve body, and first and second seals. The stem is provided with a first cylindrical wall forming a central hole closed at its bottom end, the said first cylindrical wall being provided close to the bottom of the central hole with a first radial hole putting the inside of the central hole in contact with the outside of the stem, and a second cylindrical wall concentric with the first and situated outside it so as to form an annular channel between the two cylindrical walls, the said channel being open in its top part and closed in its bottom part so as not to cross the first radial hole, a second radial hole passing through this second wall so as to put the inside of the annular channel in contact with the outside of the stem. The valve body is provided with a first main part provided with an axial channel in which the stem fits in abutment on a spring held in the axial channel by retaining means, this first main part being able to be provided with a bottom tenon on which a tube can be placed, the first pouch being able to be fixed to the external face of this first main part, and a second main part in the form of a collar concentric with the first main part and covering it partially so as to form an annular channel between the two main parts, this annular channel having, in its bottom, at the junction between the two main parts, orifices. The first seal forms part of the first means of obstructing the first passage and provides a seal between the inside of the second pouch and the outside of the valve, while the second seal forms part of the second means of obstructing the second passage and provides a seal between the inside of the first pouch and the second passage.

BRIEF DESCRIPTION OF THE DRAWINGS

The invention is disclosed in more detail hereinafter with the help of an example embodiment presented in the following figures:

FIG. 3: the valve body seen a) from the side, b) in perspective and c) from above;

DETAILED DESCRIPTION OF PARTICULAR EMBODIMENTS

Figure 1:
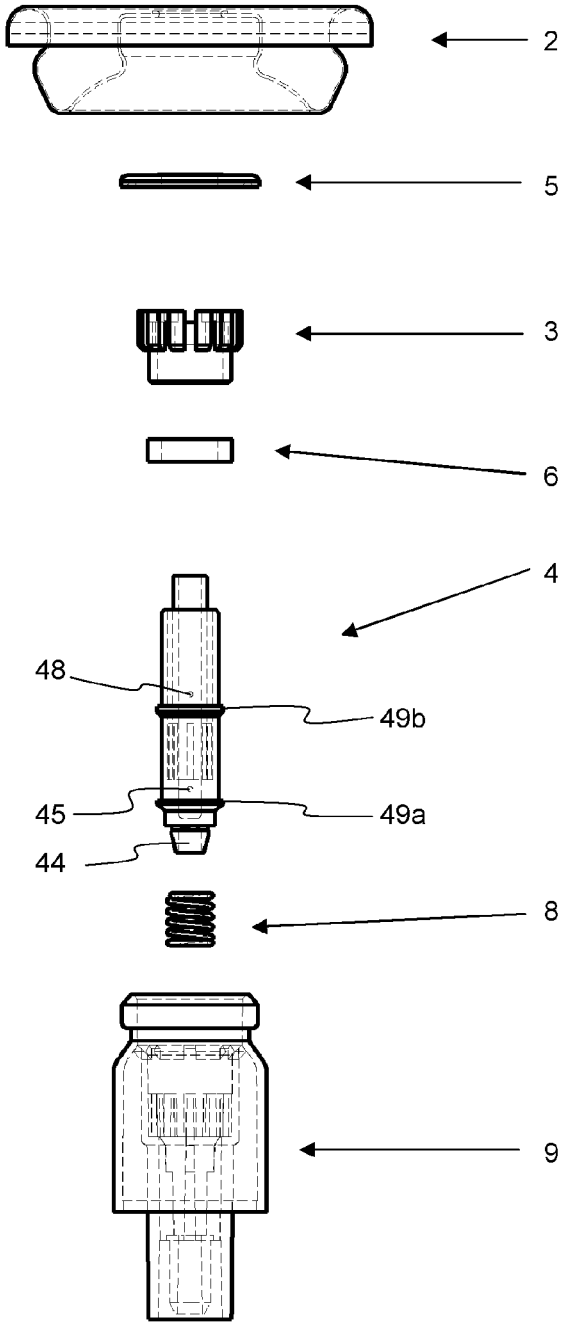
FIG. 1: exploded view of the valve showing its various constituents.
Figure 2:
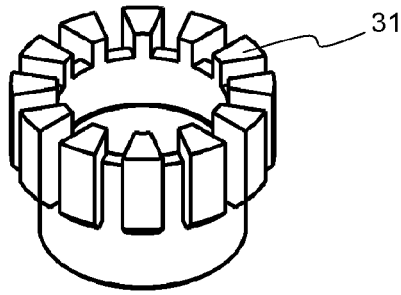
FIG. 2: perspective view of the strut.
Figure 4:
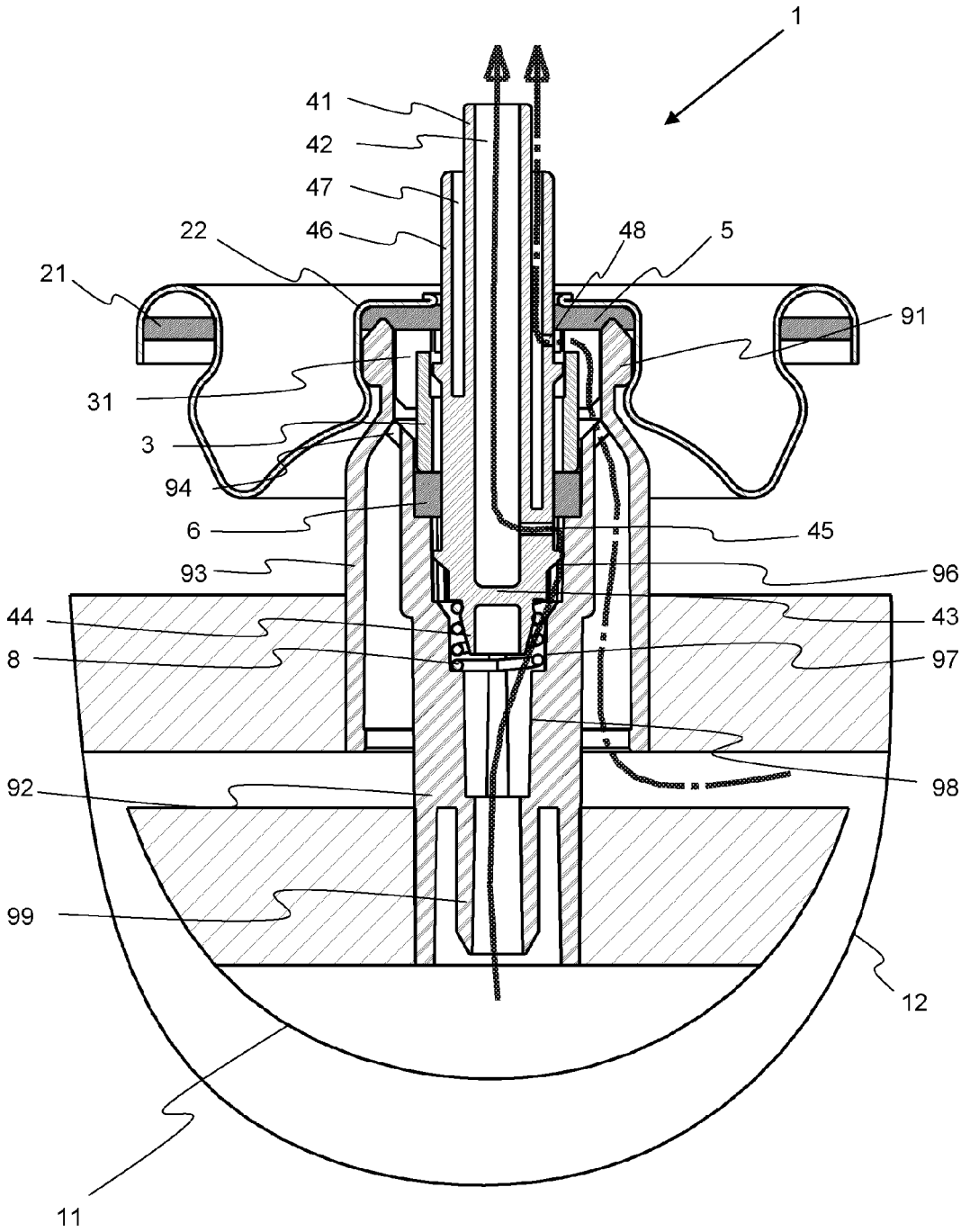
FIG. 4: view in section through the valve in the open position, the section passing through the ribs of the valve body and the passages of the two fluids being indicated.
Figure 5:
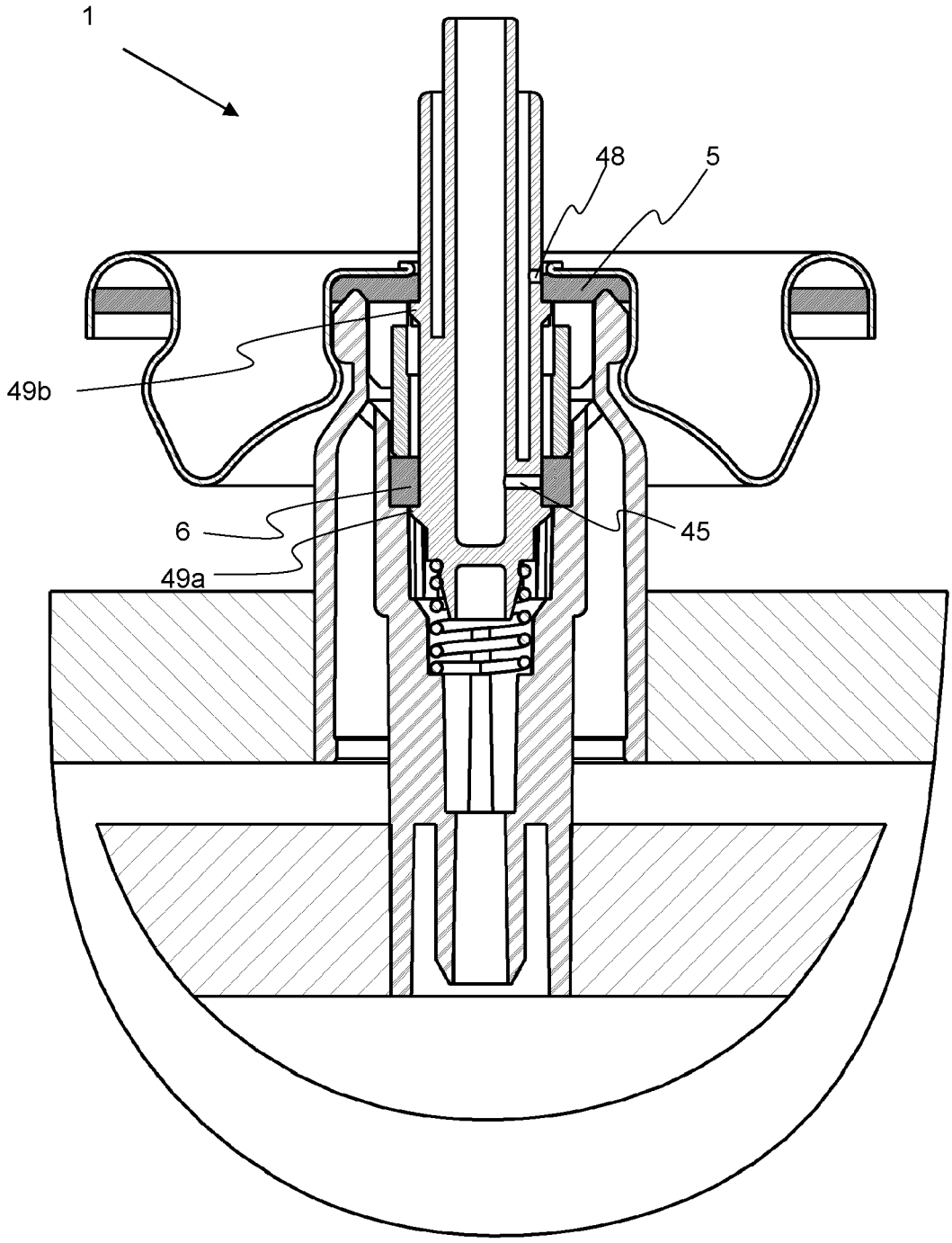
FIG. 5: the same view as that in FIG. 4, the valve being in the closed position.
Figure 6:
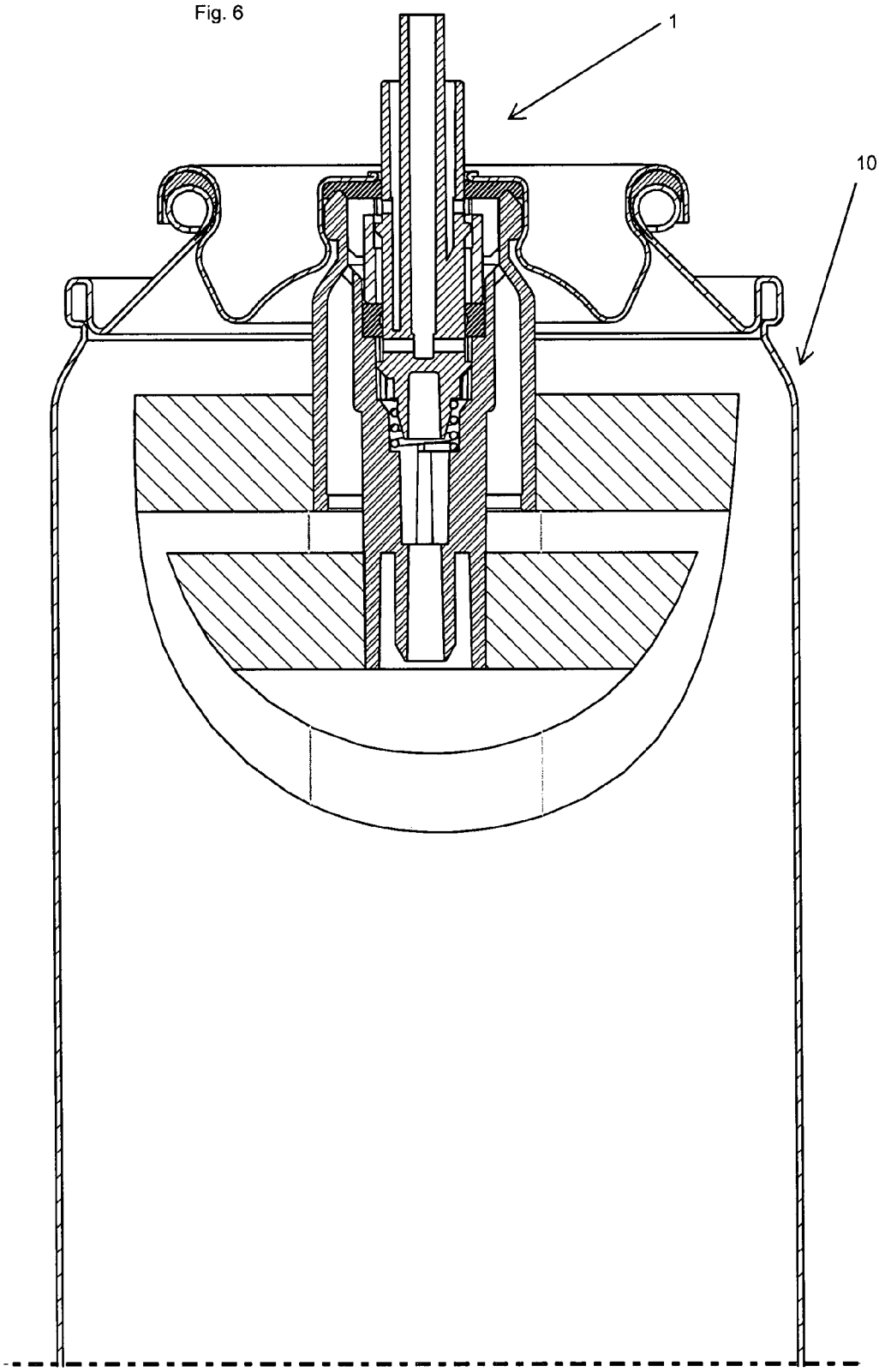
FIG. 6: side view of a rigid receptacle having a valve according to the invention mounted thereon.

The valve (1) of the invention is intended to close a dispensing flask containing at least two fluids that have, for various reasons, to be isolated from each other during storage. The valve (1) is fixed to a rigid flask (10), by fixing means such as a cup (2). A so-called external seal (21) is placed between the neck of the flask and the cup (2) in order to provide a seal there. Conventionally, the valve (1) is fixed to the dome (22) of the cup (2).

The valve (1) consist essentially of

- a valve body (9) fixed to the dome (22) of the cup (2),
- a stem (4) situated in the valve body (9), in which it can move axially between a closed position and an open position,
- a spring (8) tending to return the stem (4) to the closed position; as well as
- a strut (3); and
- two internal seals (5, 6).

Two flexible pouches (11, 12) are welded to the valve body (9), the first (11) being placed inside the second (12).

The valve body (9) consists of a top part (91) having the form of a cylindrical ring that is intended to be fixed in the dome (22) of the cup (2). A first internal seal (5) is placed between the front face of this top part (91) and the bottom of the dome (22) in order to provide a seal. This seal is improved by virtue of the triangular transverse section of the front face of this top part (91).

This top ring (91) of the valve body (9) is extended by an intermediate cylindrical annular part, with a smaller outside diameter, which then separates into two concentric substantially cylindrical main parts (92, 93), connected together at this intermediate annular part. Orifices (94) are produced in this intermediate junction zone, thus putting in contact the annular channel situated between the two main parts (92, 93) and the space situated inside the top ring (91).

The first main part (92) is pierced by an axial channel (95) provided in its bottom part with radial ribs directed towards the centre of the axial channel (95). These ribs have a radial length that increases in three successive stages. The first stage of the ribs (96) provides firstly, in its top part, a stop for a seal described below and secondly a guide for the sliding of the stem (4), the second stage of the ribs (97) provides the guidance of the spring (8) and the third stage of the ribs (98) provides in its top part a support for the spring (8). A bottom tenon (99) extending the third set of ribs (98) is provided for fitting a tube that is to be immersed in the first pouch (11).

The second main part (93) is in the form of a cylindrical collar surrounding the top part of the first main part (92). There is formed, between the internal face of this collar (93) and the external face of the first main part (92), an annular channel concentric with the first main part (92) and open towards the bottom. The top end of this annular channel terminates in the orifices (94).

The first flexible pouch (11) is welded to the external face of the first main part (92), which projects beyond the collar (93), while the second flexible pouch (12) is fixed to the external face of the second main part (93) in the form of a collar. These pouches are fixed for example by welding. The two pouches (11, 12) are closed everywhere and communicate with the outside only by means of the first passage (42, 45, 95) and the second passage (47, 48, 94) respectively.

The stem (4) has an essentially cylindrical external shape and has a first cylindrical wall (41) forming a central hole (42) closed at its bottom end (43). The bottom end of the stem (4) terminates in a cylindrical tenon (44) with a diameter less than the outside diameter of the stem (4). The spring (8) is placed on this tenon (44). A first radial hole (45) is formed in the first wall (41) of the stem (4), close to the bottom end of the central hole (42). This first radial hole (45) therefore puts in contact the inside of the central hole (42) and the outside face of the stem (4).

The stem (4) is also provided with a second cylindrical wall (46) concentric with the first (41), surrounding it so as to form an annular channel (47), concentric with the central hole (42). This annular channel (47) is open towards the top and closed towards the bottom, and its length is such that the first radial hole (45) does not pass through it. A second radial hole (48) passes through the second cylindrical wall (46) so as to put the inside of the annular channel (47) and the outside of the stem (4) in contact.

The stem (4) is also provided with two circular stops (49*a*, 49*b*) situated on its periphery, the first (49*a*) slightly below the first radial hole (45) putting the central hole (42) of the stem (4) in contact with the outside thereof, and the second (49*b*) slightly below the second radial hold (48) putting in contact the inside of the annular channel (47) and the outside of the stem (4). The outside diameter of the first stop (49*a*) corresponds substantially to the diameter of the cylinder formed by the internal ends of the first part of the ribs (95) of the axial channel (95) of the valve body (9). The outside diameter of the second stop (49*b*) corresponds substantially to the inside diameter of the strut (3).

The strut (3) is formed by a hollow cylinder provided in its top part with radial ribs (31) directed towards the outside.

In the assembled state, the valve body (9) is fixed to the cup (2) for example by crimping. The spring (8) is placed in the axial channel (95) passing right through the valve body (9), in abutment on the third stage (98) of the ribs and guided in a channel formed by the second stage (97) of these ribs. The stem (4) is placed in the valve body (9) with its tenon (44) directed downwards and placed in the top end of the spring (8). The second seal (6) is placed on the stem (4), which it grips in order to provide the seal, without for all that blocking its sliding. It is in abutment on the first stage of the ribs (96). Finally, the strut (3) is placed inside the axial channel (95) of the valve body (9), around the stem (4) between the first internal seal (5) and the second internal seal (6).

The stops (49*a*, 49*b*) of the stem (4) are placed so that, in the closed position, in which the stem (4) is pushed upwards by the spring (8), the second stop (49*b*) bears on the bottom face of the first internal seal (5) while the first stop (49*a*) bears on the bottom face of the second internal seal (6). The stem (4) can therefore not emerge from the valve (1).

The radial holes (45, 48) putting in contact on the one hand the inside of the central hole (42) and on the other hand the annular channel (47) with the outside of the stem (4) are placed so that, in the closed position, these radial holes (45, 48) emerge at the second internal seal (6) and the first internal seal (5) respectively thus forming blind holes. The first wall (41) and the second wall (46) of the stem (4) therefore form movable walls that make it possible to put the radial holes (45, 48) either facing a wall while blocking them, namely the second and first internal seal (6, 5) respectively, or facing a space in contact with the inside of the first and second pouch (11, 12) respectively.

By virtue in particular of the second internal seal (6), there is indeed a physical separation between on the one hand the inside of the first pouch (11) that is in contact with the inside of the first main part (92) and on the other hand the inside of the second pouch (2) that is in contact with the annular space situated between the collar (93) and the first main part (92) as well as with the space situated inside the top ring (91) of the valve body (9).

If an axial force is exerted downwards on the top end of the stem (4), which projects out of the receptacle, for example by means of a diffuser placed on the valve, the stem (4) moves downwards in the valve body (9) counter to the effect of the spring (8) and the radial holes (44, 48) emerge from the internal seals (5, 6), thus opening two passages for the fluids contained in the pouches (11, 12).

The fluid contained in the first pouch (11) passes through the tenon (99), then into the space situated between the various stages (96, 97, 98) of the ribs, before passing through the first radial hole (45) and following the central hole (42) of the stem (4) and emerging from the valve (1).

The fluid contained in the second pouch (12) passes through the annular space situated between the first main part (92) and the second main part (93) in the form of a collar, passes through the orifices (94), arrives in the space situated in the top ring (91) between the ribs (31) of the strut (3), passes through the second radial hole (48) and then the axial channel (47) before emerging.

It is only at this top end of the stem (4) that the two fluids encounter each other.

The propulsion means consist in a novel fashion of a gas placed in the receptacle. The fluids contained in the flexible pouches (11, 12) are not in contact with the gas but are subjected to the pressure that it exerts on the wall of the external pouch (12). The fluid in this second pouch transmits the pressure to the internal pouch (11).

In the example presented, the gas does have the possibility of emerging from the receptacle. However, it would be possible to provide, for example in the transient part of the stem (4), an orifice provided with closure means so that the gas can escape through the same path as the second fluid when the valve is actuated. Nothing prevents adding to this propellant gas a third fluid with which it does not react. The receptacle then contains three fluids separated physically from one another during storage.

The number and dimensions of the radial holes putting firstly the inside of the central hole (42) and secondly the inside of the annular channel (47) in contact with the outside of the stem (4) can vary according to requirements, in particular according to the volume ratio to be taken off between the two fluids or their respective viscosities.

The arrangement of the radial holes (45, 48) is chosen so that, in the closed position, they are closed by the first and second internal seals (5, 6) and so that they are open in the open position. It is however not necessary for the distance that separates them to correspond exactly to the distance that separates the bottom faces of the internal seals (5, 6). If the two distances are equal, then the two holes will open and close simultaneously. In the contrary case, one of the two will open before and will close after the other. There will thus be a delayed opening of one of the passages.

Moreover, it is not necessary to for the passages to be concentric; they may also be parallel, the important thing being that they are opened and closed by the same valve. In particular, the annular channel (47) could be replaced by a channel simply parallel to the central hole (42).

The pouches can be produced in all sorts of materials, which will be chosen according to the use adopted for the valve.

In practice, the valve is manufactured during a first step and mounted on the cup (2). The pouches (11, 12) are coiled and maintained in this position by retaining means such as a self-adhesive strip. The valve thus presented is supplied to the packaging factory, where the valve is fixed by its cup to a flask before filling commences through the valve. The self-adhesive strip then yields under the effect of the filling pressure. The valve according to the invention can be used whenever it is necessary, or at least desirable, to separate the various components of the end product during storage. It will find applications in particular in pharmacy, cosmetics, the food industry, or for technical uses such as adhesives.

LIST OF REFERENCES

1 Two-way valve
- 11 First pouch
- 12 Second pouch

2 Cup
- 21 External seal
- 22 Dome

3 Strut
- 31 Radial ribs directed towards the outside

4 Two-way stem
- 41 First cylindrical wall
- 42 Central hole
- 43 Bottom end of central hole
- 44 Tenon
- 45 First radial hole
- 46 Second cylindrical wall
- 47 Annular channel
- 48 Second radial hole
- 49*a* First stop
- 49*b* Second stop

5 First internal seal
6 Second internal seal
8 Spring
9 Valve body
- 91 Top ring
- 92 First main part
- 93 Second main part in the form of a collar
- 94 Orifices
- 95 Axial channel
- 96 First part of ribs
- 97 Second part of ribs
- 98 Third part of ribs
- 99 Bottom tenon

10 Rigid receptacle

The invention claimed is:

1. Valve for the distribution of two fluids and intended to be fixed on a rigid receptacle, wherein the valve is configured with an outside face and an inside face, wherein the outside face is intended to be located on an outside face of the receptacle when the valve is fixed on the receptacle and the inside face is intended to be located within the receptacle when the valve is fixed on the receptacle, wherein the valve comprises a first flexible pouch intended to receive a first fluid;

a second flexible pouch intended to receive a second fluid; the first pouch being placed inside the second pouch;

a first passage connecting an inside of the first pouch with a first opening on the outside face of the valve;

a second passage connecting an inside of the second pouch with a second opening on the outside face of the valve, first closure means for closing the first passage and second closure means for closing the second passage;

wherein the first passage and the second passage do not have any portion in common, wherein the valve comprises a valve body intended to be secured to a cup intended to be fixed to the rigid receptacle, and a stem placed in the valve body and provided with means for moving the stem between a first position in which the first and second closure means are closed and a second position in which the first and second closure means are open, and wherein the stem is provided with a first cylindrical wall forming a central hole closed at a bottom end of the central hole, the first cylindrical wall being provided close to the bottom end of the central hole with a first radial hole putting an inside of the central hole in contact with an outside of the stem;

a second cylindrical wall concentric with the first cylindrical wall and situated outside the first cylindrical wall so as to form a first annular channel between the first and second cylindrical walls, the first annular channel being open in a top part of the first annular channel and closed in a bottom part of the first annular channel so as not to cross the first radial hole, a second radial hole passing through this second wall so as to put an inside of the first annular channel in contact with the outside of the stem;

the valve body is provided with a first main part provided with an axial channel in which the stem fits in abutment on a spring held in the axial channel by retaining means, the first main part being able to be provided with a bottom tenon on which a tube can be placed, the first pouch being able to be fixed to an external face of the first main part;

a second main part in the form of a collar concentric with the first main part and partially covering the first main part so as to form a second annular channel between the first and second main parts, the second annular channel having, in a bottom of the second annular channel, at the junction between the first and second main parts, orifices;

and the valve comprises a first seal being a part of the first means for closing the first passage and sealing the inside of the second pouch from the outside face of the valve, and a second seal being a part of the second means for closing the second passage and sealing the inside of the first pouch from the second passage.

2. Valve according to the claim 1, wherein the first passage is provided with the first closure means, which, when the first closure means are open, put in contact the inside of the first pouch with the outside face of the valve, and when the first closure means are closed, isolate the inside of the first pouch from the outside face of the valve, and the second passage is provided with the second closure means which, when the second closure means are open, put in contact the inside of the second pouch with the outside face of the valve, and when the second closure means are closed, isolate the inside of the second pouch from the outside face of the valve.

3. Valve according to claim 1, wherein the first passage and the second passage comprise two concentric channels.

4. Valve according to claim 1, wherein a third passage is provided with third closure means which, when the third closure means are open, put in contact a space situated outside the second pouch, but on the inside face of the valve, with the outside face of the valve, and when the third closure means are closed, isolate the space situated outside the second pouch, but on the inside face of the valve, from the outside face of the valve, the third passage emerging in the first or second passage downstream, with respect to the direction of travel of the fluids when taking off, of the first closure means of the first passage or of the second closure means of the second passage.

5. Valve according to claim 1, wherein each of the first and second closure means comprise a respective first and second hole produced in a wall able to move between a position in which the first and second holes emerge on one side at least on a second wall so that they form blind holes and a position in which the first and second holes emerge, on one side of the first and second holes, on spaces in contact with the inside of the pouches, and on another side of the first and second holes, on spaces in contact with the outside face of the valve.

6. Valve according to claim 1, wherein the means for moving the stem between the two positions comprise (i) a spring and (ii) means on which a force counter to the action of the spring can be exerted.

7. Rigid receptacle comprising a valve according to claim 1 mounted onto the rigid receptacle and propulsion means in form of means for exerting a pressure on the second flexible pouch.

8. Receptacle according to claim 7, wherein the means for exerting a pressure on the second flexible pouch are formed by a pressurised gas contained in the rigid receptacle in which the two pouches are placed.

9. Valve for the distribution of two fluids and intended to be fixed on a rigid receptacle, wherein the valve is configured with an outside face and an inside face, wherein the outside face is intended to be located out of the receptacle when the valve is fixed on the receptacle and the inside face is intended to be located within the receptacle when the valve is fixed on the receptacle, wherein the valve comprises a first flexible pouch intended to receive a first fluid;

a second flexible pouch intended to receive a second fluid; the first pouch being placed inside the second pouch;

a first passage connecting an inside of the first pouch with the outside face of the valve;

a second passage connecting an inside of the second pouch with the outside face of the valve, first closure means for closing the first passage and second closure means for closing the second passage;

wherein the valve comprises a valve body intended to be secured to a cup intended to be fixed to the rigid receptacle, and a stem placed in the valve body and provided with means for moving the stem between a first position in which the first and second closure means are closed and a second position in which the first and second closure means are open, and the stem is provided with a first cylindrical wall forming a central hole closed at a bottom end of the central hole, the first cylindrical wall being provided close to the bottom end of the central hole with a first radial hole putting an inside of the central hole in contact with an outside of the stem;

a second cylindrical wall concentric with the first cylindrical wall and situated outside the first cylindrical wall so as to form a first annular channel between the first and second cylindrical walls, the first annular channel being open in a top part of the first annular channel and closed in a bottom part of the first annular channel so as not to cross the first radial hole, a second radial hole passing through this second wall so as to put an inside of the first annular channel in contact with the outside of the stem; the valve body is provided with a first main part provided with an axial channel in which the stem fits in abutment on a spring held in the axial channel by retaining means, the first main part being able to be provided with a bottom tenon on which a tube can be placed, the first pouch being able to be fixed to an external face of the first main part;

a second main part in the form of a collar concentric with the first main part and partially covering the first main part so as to form a second annular channel between the first and second main parts, the second annular channel having, in a bottom of the second annular channel, at the junction between the first and second main parts, orifices;

and the valve comprises a first seal being a part of the first means for closing the first passage and sealing the inside of the second pouch from the outside face of the valve, and a second seal being a part of the second means for closing the second passage and sealing the inside of the first pouch from the second passage.

10. Valve according to the claim 9, wherein the first passage is provided with the first closure means, which, when the first closure means are open, put in contact the inside of the first pouch with the outside face of the valve, and when the first closure means are closed, isolate the inside of the first pouch from the outside face of the valve, and the second passage is provided with the second closure means which, when the second closure means are open, put in contact the inside of the second pouch with the outside face of the valve, and when the second closure means are closed, isolate the inside of the second pouch from the outside face of the valve.

11. Valve according to claim 9, wherein the first passage and the second passage comprise two concentric channels, one of which is put into contact with the first flexible pouch and the other with the second flexible pouch when the respective first and second closure means are open.

12. Valve according to claim 9, wherein a third passage is provided with third closure means which, when the third closure means are open, put in contact a space situated outside the second pouch, but on the inside face of the valve, with the outside face of the valve, and when the third closure means are closed, isolate the space situated outside the second pouch, but on the inside face of the valve, from the outside face of the valve, the third passage emerging in the first or second passage downstream, with respect to the direction of travel of the fluids when taking off, of the first closure means of the first passage or of the second closure means of the second passage.

13. Valve according to claim 9, wherein each of the first and second closure means comprise a respective first and second hole produced in a wall able to move between a position in which the first and second holes emerge on one side at least on a second wall so that they form blind holes and a position in which the first and second holes emerge, on one side of the first and second holes, on spaces in contact with the inside of the pouches, and on another side of the first and second holes, on spaces in contact with the outside face of the valve.

14. Valve according to claim 9, wherein the means for moving the stem between the two positions comprise (i) a spring and (ii) means on which a force counter to the action of the spring can be exerted.

15. Rigid receptacle comprising a valve according to claim 9 mounted onto the rigid receptacle and propulsion means in form of means for exerting a pressure on the second flexible pouch.

16. Receptacle according to claim 15, wherein the means for exerting a pressure on the second flexible pouch are formed by a pressurised gas contained in the rigid receptacle in which the two pouches are placed.

* * * * *